US005836420A

United States Patent [19]

Marky, Jr.

[11] Patent Number: 5,836,420

[45] Date of Patent: Nov. 17, 1998

[54] LADDER PLATFORM DEVICE

[76] Inventor: Raymond L. Marky, Jr., 316 Garner Ct., Tallahassee, Fla. 32301

[21] Appl. No.: 780,710

[22] Filed: Jan. 8, 1997

Related U.S. Application Data

[63] Continuation of Ser. No. 342,915, Nov. 21, 1994, abandoned.

[51] Int. Cl.[6] ..... E06C 7/16

[52] U.S. Cl. ..... 182/121; 248/238

[58] Field of Search ..... 182/120–123; 248/210, 238

[56] References Cited

U.S. PATENT DOCUMENTS

| | | | |
|---|---|---|---|
| 1,452,182 | 4/1923 | Butrum | 182/121 |
| 1,645,879 | 10/1927 | Skeels | 248/238 X |
| 2,641,511 | 6/1953 | McClure | 182/121 |
| 3,552,523 | 1/1971 | Berkley | 182/121 |
| 4,482,030 | 11/1984 | Cincourt | 182/121 X |
| 4,911,265 | 3/1990 | Skaggs | 182/121 |
| 5,052,515 | 10/1991 | Nowlan | 182/121 |
| 5,060,755 | 10/1991 | Bourdages | 182/121 |
| 5,191,954 | 3/1993 | Ledford | 182/121 |

FOREIGN PATENT DOCUMENTS

| | | | |
|---|---|---|---|
| 2057368 | 5/1972 | Germany | 182/95 |
| 1179970 | 2/1970 | United Kingdom | 182/121 |

*Primary Examiner*—Alvin C. Chin-Shue
*Attorney, Agent, or Firm*—Carnes Cona and Dixon

[57] ABSTRACT

The present invention provides for a platform to be used with a ladder that includes a frame having a top portion, a middle portion and a lower portion. The top portion of the frame includes a hook-like feature that engages the front and upper surfaces of an upper rung and the lower portion includes a stop that engages the front surface of a lower rung to provide for a middle rung to be located between the upper run and the lower rung. This will provide for the frame to extend the length of three rungs. A support or platform is located on the lower portion of the frame and receives the feet of a user.

14 Claims, 5 Drawing Sheets

LADDER PLATFORM DEVICE

This is a continuation of application Ser. No. 08/342,915, filed Nov. 21, 1994, now abandoned.

BACKGROUND OF THE INVENTION

1. Field of the Invention

The present invention relates generally to a platform device and more particularly to a platform device with adjustable components so that the platform device can be utilized with any model or type of commercially available ladder.

2. Description of the Prior Art

It has long been recognized that there is a multiplicity of platforms that are used with various commercially available ladders. These platforms are used to assists and alleviate the discomfort for an individual who must be on the ladder for an extensive period of time.

One such platform is disclosed in U.S. Pat. No. 5,052,515 issued to Nowlan. Nowlan discloses a simple one piece platform device that is secured on two consecutive rungs. The platform device disclosed by Nowlan seems to be useful yet dangerous. Firstly, the surface for which an individual places their feet on the platform disclosed in Nowlan is on the front of the ladder. This surface would appear to obstruct moving up or down the ladder and the user must stand away from the ladder creating an unnecessary hazard. Additionally, the platform device disclosed in Nowlan permits an individual to use platform device on the uppermost rungs on a ladder. Normally, the uppermost rungs on the ladder are not meant to be used. Further, Nowlan is silent on a means of adjusting the length of the platform to permit for it to be used on various model of ladders.

U.S. Pat. No. 4,911,265, issue to Skaggs, discloses ladder platform that is secured to the rungs of the ladder so that the surface of the platform is not in the way of one moving up or down. This platform device disclosed by Skaggs is made of several components. These plurality of components provide for a device that is cumbersome to use and adjust. Moreover extensive design places obstruction in the area of the users feet which could result in clothing entanglement and/or tripping by the user.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a platform device that is adapted to be removably secured to the rungs of any commercially available ladder. The platform device of the present invention consists of a top portion, a middle portion and a bottom portion. This platform device, once attached to a commercially available ladder, will extend pass three rungs.

The top portion is adapted to engage a first or top rung of a ladder while the bottom portion is adapted to engage a lower or bottom rung of a ladder to provide for a middle rung to be located therebetween. This bottom portion includes a platform to enable a person to rest their feet while using the ladder. This resting place provides a comfortable means of supporting the weight and feet, inherently enabling a longer use of the ladder with little or no tiring of the legs or feet of the user. A pair of elongated rods, parallel to each other, constitutes the middle portion of the platform device and it is located between the top and bottom portion.

The length of platform device (length between the rungs) can be adjusted by a length adjusting means. This length adjusting means is located in the middle portion of the platform device.

Accordingly, it is an object of the present invention to provide for an improved platform device that is adapted to be removably secured to the rungs of a conventional ladder.

It is yet another object of the present invention to provide for an improved platform device that has adjustable components so as to be utilized by a plurality of different types and models of ladders.

Still another object of the present invention is to provide an improved platform device that is comfortable for the user as well as being simple in design and operation.

It is still a further object of the present invention to provide for an improved platform device that is functional, spacious, and not hazardous to the user.

It is yet another object of the present invention to provide a platform device which is arranged so that once secured to the ladder, will provide for the surface to be behind the rungs of a ladder.

Still a further object of the present invention is to provide for a platform device that can be placed anywhere on the ladder so as to allow the user to modify his height from the ground and place it at the most comfortable and convenient height.

A final object of the present invention, to be specifically enumerated herein, is to provide a platform device in accordance with the preceding objects and which will conform to conventional forms of manufacture, be of simple construction and easy to use so as to provide a device that would be economically feasible, long lasting and relatively trouble free in operation.

Although there have been many inventions related to a platform device none of the inventions have become sufficiently simple in design, compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to like features throughout the several views of the drawings.

DESCRIPTION OF THE PREFERRED EMBODIMENTS

Figure 1:
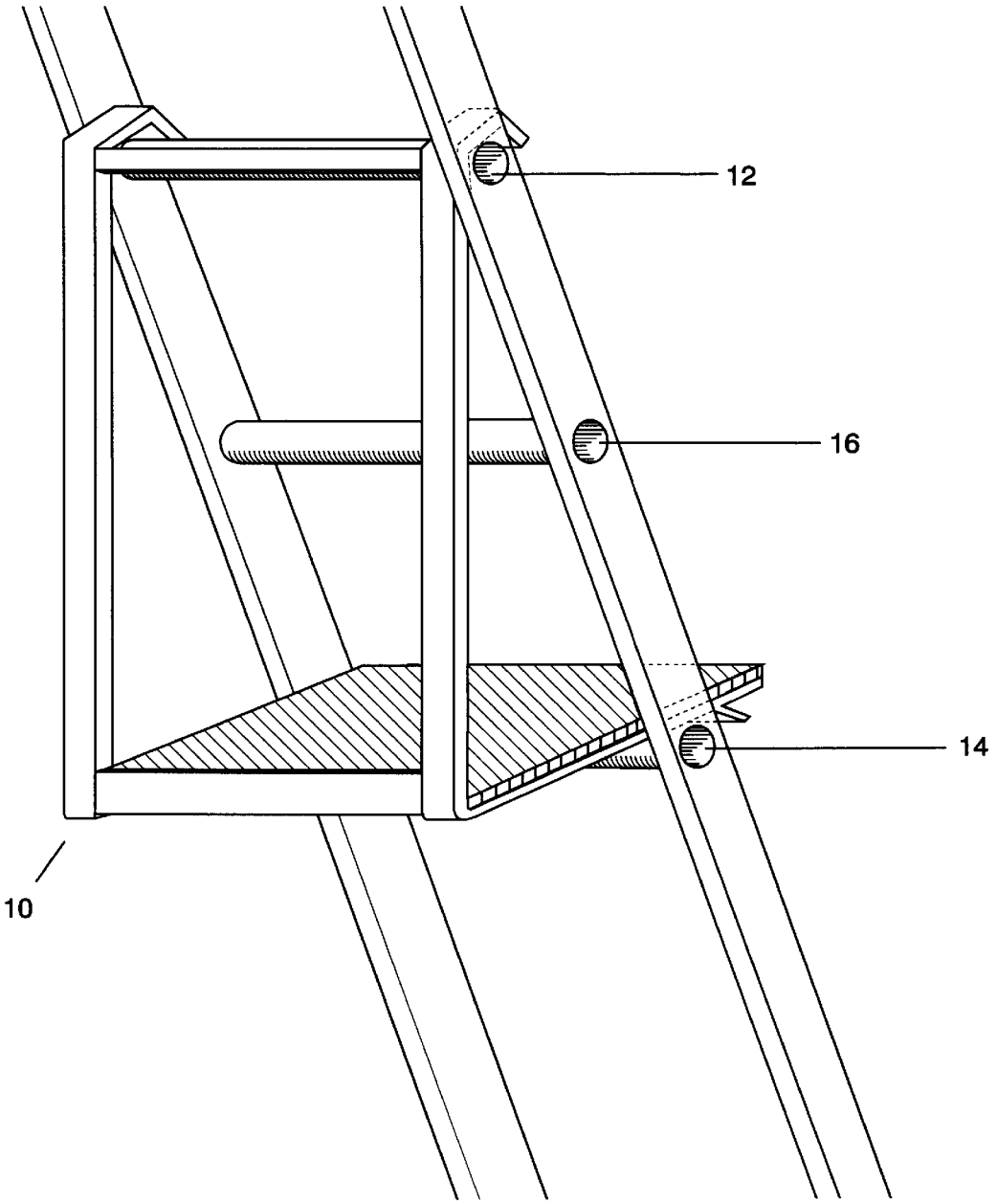
FIG. 1 is a perspective view of the first embodiment of the platform device of the present invention attached to a conventional ladder.
Figure 2:
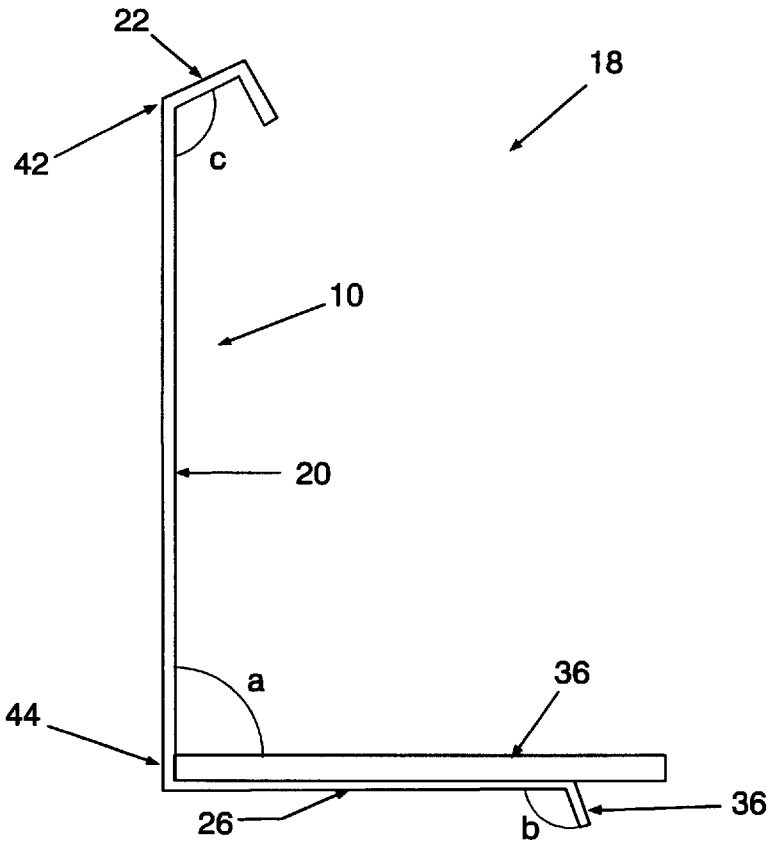
FIG. 2 is a side view of the fist embodiment of the platform device of the present.
Figure 3:
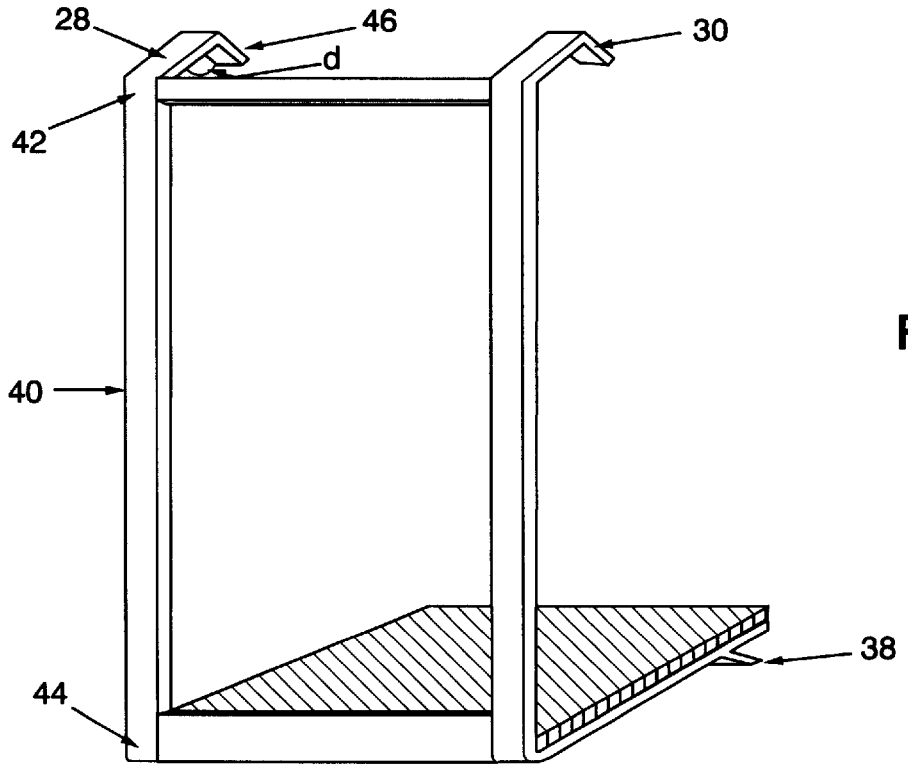
FIG. 3 is a back perspective view of the first embodiment of the platform device of the present invention.
Figure 4:
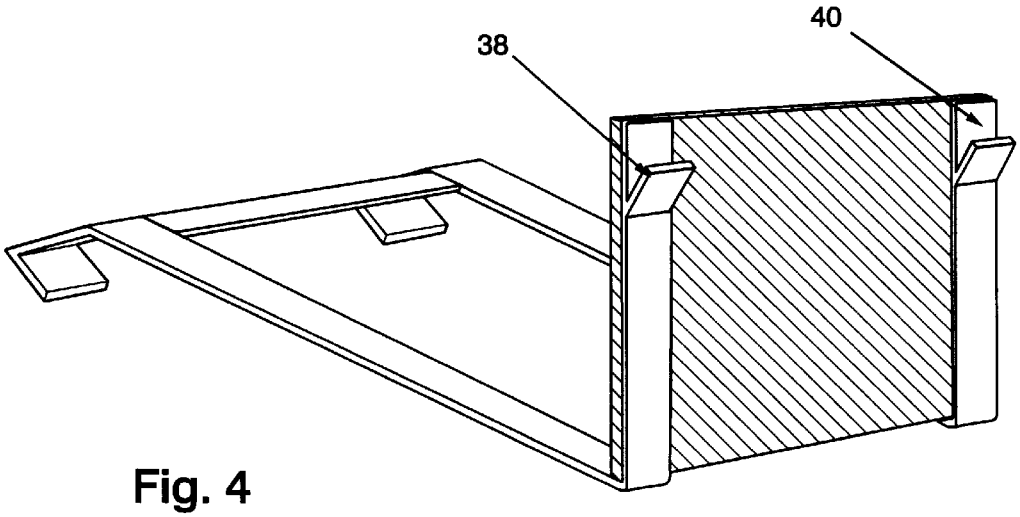
FIG. 4 is a perspective bottom view of the first embodiment of the platform device of the present invention.

FIGS. 1–4 illustrate the various views of the first embodiment of the platform device of the present invention. As illustrated the platform device 10 covers an area which consists of three rungs. This platform device 10 is securely fastened to the back of a conventional ladder (illustrated but not labeled) on an upper rung 12 and a lower rung 14, while the middle rung 16 is not utilized.

Normally, manufacturers of ladders will attach a warning means stating that the upper two rungs of the ladder should not be used, due to lack of stability. This design provides an added safety feature which will not permit for the platform to be utilized on the two uppermost rungs. Expanding the platform device of the present invention to extend across three rungs will inherently not permit utilization of the upper most rungs. Additionally, enabling the platform device to expand the length of three rungs provides for more clearance in the area of the feet of the user. This will eliminate any possibility of the user from tripping or slipping due to lack of clearance.

The platform device 10 includes a front portion 18, a middle area 20, a top area 22, rear portion (not labeled), and a lower area 26. The top area 22 of the front portion 18 of the platform device is attached to the upper rung 12 of the ladder while the lower area 26 of the front portion 18 of the platform device is attached to the lower rung 14 of the ladder. The top, middle and lower areas of the platform device form a frame 40.

The lower portion of the platform device (see FIGS. 1–4) includes a platform or support 36 having a substantially square shape. This platform or support receives the feet of the user and is affixed to the frame 40. The design of the platform device of the present invention is such that once the platform device is installed and attached to the ladder, the platform or support 36 will be located rearwardly from the ladder. Thereby, providing no obstruction to exist between the user and the platform device 10. The platform or support is located on the lower area of the frame.

This support 36 can be fabricated from a variety of materials. It is noted that steel having perforations therein (giving the appearance of net-like material) has been utilized to produce excellent results. Other material of a varying degree of hardness may also be utilized. These materials include, but are not limited to, wood, hard plastic, and metal. The support can further include a non-skid surface. This non-skid surface can include a rubberized top or a roughened top surface.

The lower area of the frame 40 (as illustrated in the bottom view in FIG. 4) is located on the perimeter of the bottom surface of the platform or support 36. A pair of stops 38, parallel to one another, are attached to the bottom surface of the frame. This attachment to the bottom surface of the support is at an obtuse angle (b). This obtuse angle should be approximately 110–125 degrees. The upper surface of the lower portion is secured to the middle portion at a right angle (a).

These stops 38 are affixed behind the bottom or lower rung 14 when the platform device is in use. Due to the obtuse angle (b) of the stop with respect to the bottom surface of the frame, the platform device will fit securely on the ladder while the support 36 will be parallel to the ground (see FIG. 1).

It is noted that the lower area of the frame illustrated in these figures has two parallel members. However, it is noted that this lower area of the frame can be solid to provide for the lower area of the frame to have a square shape. It is also noted that the above-identified figures illustrate the use of two stops 38. It is noted that the stop can be modified as well. If the lower area of the frame were to have a square shape then the stop can extend across the entire length of the lower area of the frame. This will provide for a platform device to have only one stop which would extend the length of a rung when the device is secured to the ladder.

The middle portion is fabricated from a pair of elongated rods each having a first end 42 and a second end 44. This first end is attached to the top portion 22 while the second end 44 is affixed to the lower area of the frame.

Extending from each elongated rod is a hook attachment 46. This hook attachment is secured to the top or upper rung 12 when the platform device 10 is in use. These hook attachments constitutes the top portion 22.

As illustrated, the hook attachments 46 consists of a top planar wall 28 and a downward wall 30. The top planar wall 28 is attached at an obtuse (c) with respect to the elongated rod. This obtuse angle should be approximately 110–125 degrees. The obtuse angle c must be equivalent to the obtuse angle of the stop with respect to the lower area of the frame. The downward wall extends downwardly from the top wall. This downward wall is attached at a right angle (d) with respect to the top planar wall. The design and configuration will not only allow for the top portion to have a cross-sectional view that is substantially an inverted V-shape, but will also provide for the top portion to securely attach itself to the upper rung 12 of a ladder. Additionally, since angles a and d are right angles and angels b and c are equal obtuse angles, the platform or support will be situated parallel to the ground once the platform device is secured to the ladder.

The above-identified figures illustrate the first embodiment of the platform device of the present invention. It is noted that the platform device can be altered to include an adjusting means in order to provide for the height and length to be altered. The alteration provides for a second embodiment of the present invention. This second embodiment is illustrated in further detail in FIGS. 5A and 5B. As seen in these figures, the platform device is similar to the first embodiment in that the platform device 10 in that the platform device of the second embodiment includes a front portion 18, a rear portion 20, a top area 22, a middle area 24, and a lower area 26. The top area 22 of the front portion 18 of the platform device is attached to the upper rung (not illustrated) of a ladder while the lower area 26 of the front portion 18 of the platform device is attached to the lower rung (not illustrated) of the ladder.

The middle area includes a pair of hollow elongated rods. These rods can be adjusted in length to accommodate for various ladders wherein the rungs are spaced at different distances. Each elongated rod includes a first hollow shaft 32 and a second hollow shaft 34. The first shaft 32 is received in the second shaft 34 to permit for the first shaft 32 to slide freely within the second shaft of the rod. The height adjusting means permits for a secure affixment of the first shaft of the rod to the second shaft of the rod.

Figure 5A:
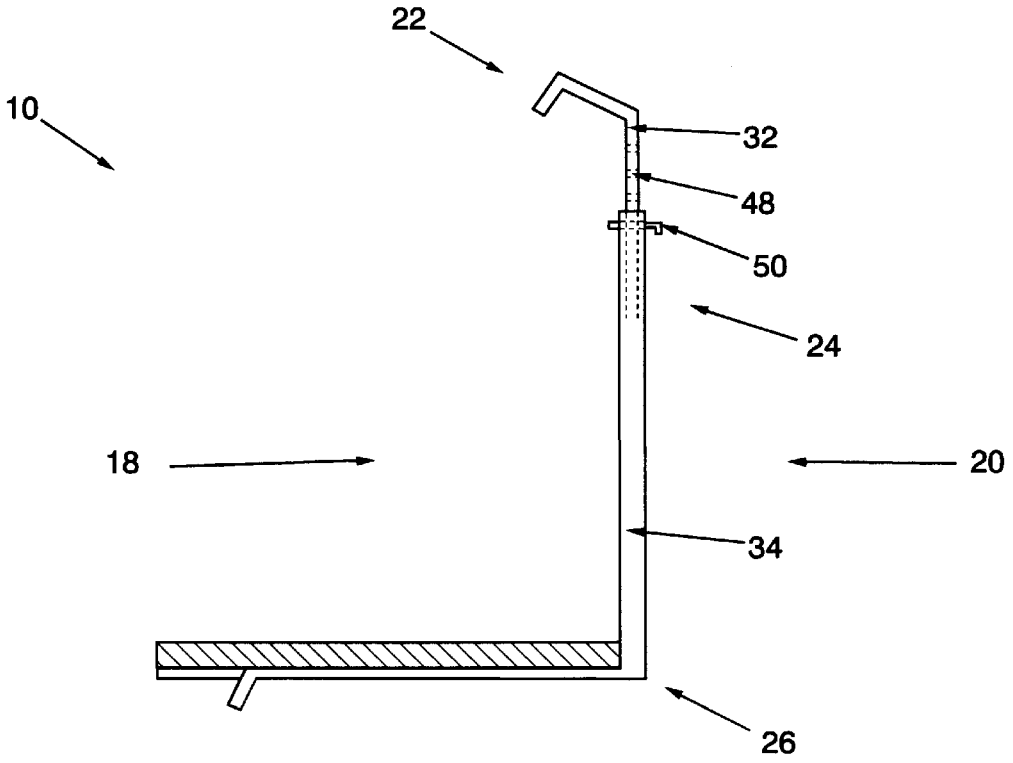
FIG. 5*a* is a side view of the second embodiment of the platform device of the present invention utilizing a first height adjustment means.

The adjusting means can incorporate several embodiments. A first example is illustrated in FIG. 5A. As seen, the first shaft 32 includes a plurality of evenly spaced holes 48 that extend through the shaft. A second set of evenly spaced holes extend through the second shaft. The first shaft is able to slide freely within the second shaft. Once the desired height is obtained and the first set of holes are aligned with the second set of holes a pin 50 would be insert into the aligned holes, thereby locking the body in a secured position.

Figure 5B:
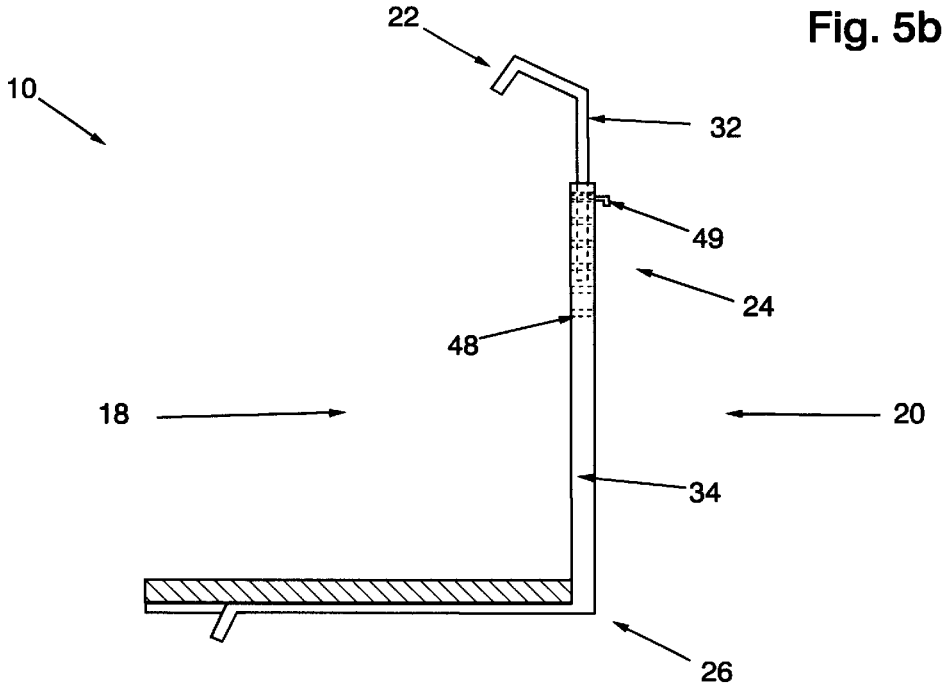
FIG. 5*b* is a side view of the second embodiment of the platform device of the present invention utilizing a second height adjusting means.

It is noted that the height adjusting mean can be altered. As illustrated in FIG. 5B this height adjusting means would provide for a first set of evenly spaced holes 48 to be located on the side of the second shaft and for a spring loaded button 49 to be located on the first shaft 32. In order to adjust the height of the rod, the button would be pressed and the first shaft would slide within the second shaft. The button emerges at the first available hole located on the second shaft, thus locking the middle portion in a fixed position. If that height is not desired then the process is continued until the desired height is obtained.

Figure 5C:
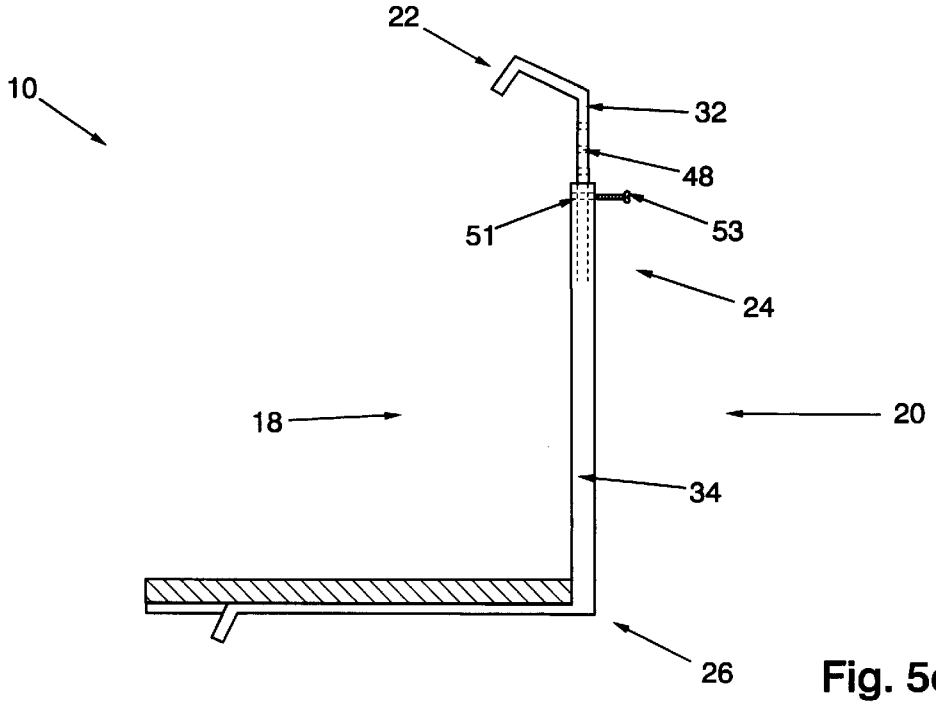
FIG. 5*c* is a side view of the second embodiment of the platform device of the present invention utilizing a third adjusting means.

In yet another adjusting means, illustrated in FIG. 5C, the first shaft 32 would include a plurality of threaded holes 48 on the encompassing side wall. A threaded aperture 51 would be located on the encompassing side wall of the second shaft. The first shaft is received in the second shaft 34 and is able to slide freely within the second shaft. In this embodiment the height would be altered by inserting a threaded screw-like device 53 into the aperture and permitting it to extend into one of the threaded holes so that the first and second shafts are locked in a fixed position.

Figure 6A:
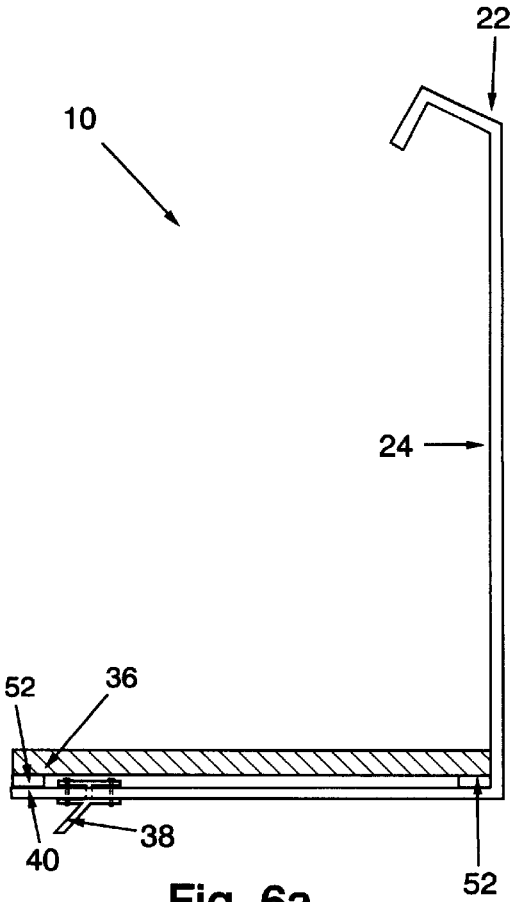
FIG. 6*a* is a side view of the third embodiment of the platform device of the present invention.
Figure 6B:
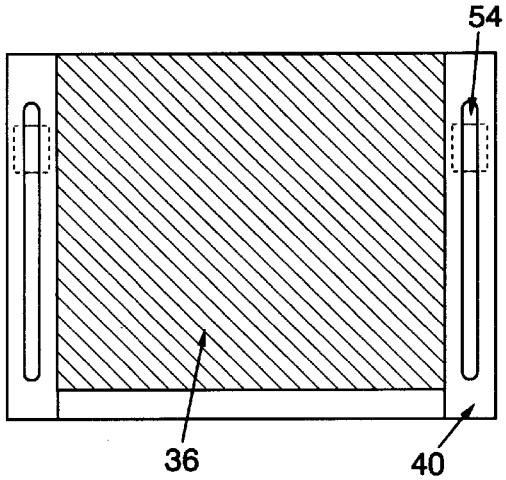
FIG. 6*b* is a bottom view of the third embodiment of the platform device of the present invention.
Figure 7:
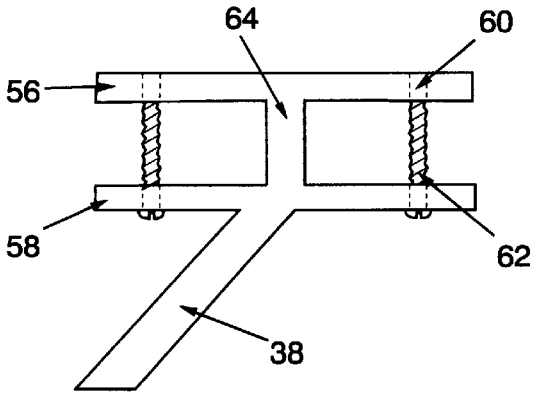
FIG. 7 is a side view of the adjusting means used third embodiment of the platform device of the present invention.

The location of the stop(s) can also be adjusted to accommodated for various models and size of ladders. This alteration of the stops is illustrated in FIGS. 6*a*–7. As seen in these figures, the platform device 10 consists of a frame 40 having a top area 22, a middle area 24, and a lower area (not labeled). The platform or support 36 is attached to the upper surface of the lower area of the frame via spacers 52. This will provide for a gap to exists between the support 36 and the lower area of the frame. The adjusting means for the stops 38 is located within this gap area.

The adjusting means for the stops includes a channel 54 for each stop. Each channel 54 will to be located on the lower area of the frame 40. Though not separately illustrated, this channel 54 includes a plurality of threaded openings which are located along the length of the channel. The adjusting means further includes a first plate 56 and a second plate 58. The first plate 56 is located within the gap area. Accordingly, this first plate is located below the support 36 yet above the lower area of the frame 40. This plate has a width and a length. The width must be wider than the width of the channel.

The second plate 58 is located parallel to the first plate and is substantially the same shape and size as the first plate. This second plate is secured to the first plate via an extension 64. The extension is centrally located on the upper surface of the second plate and extends through the channel to the first plate. This arrangement will enable the plates to travel along the channel located within the frame.

The first and second plates each include a set of threaded through holes 60. These holes in the first plate are aligned with the channel and the holes of the second plate. Accordingly, in order to secure the stop in the desired location, screw-like devices 62 are inserted into the through holes of the first plate and extends into the threaded openings of the channel and into the threaded through holes of the second plate. This will secure the plates in a fixed position.

Though not separately illustrated, it is noted that the holes can be located on the side of the channel. Holes will also be added to the lower area of the frame. Accordingly, in order to secure the stop in a desired location, screw-like devices are inserted into the holes of the first plate and extend into the holes on the lower area of the frame and into the holes of the second plate. This will secure the plates in a fixed position.

It is noted that the upper portion 22 of the platform device 10 illustrated in any of the above-identified drawings and embodiments can be altered to accommodate any shape rung. The upper portion illustrated in the figures is ideal for use with D-shaped rungs and as illustrated can be used with circular rungs. However, the hook attachments 46 can be arcuate to provide for a secure attachment to a circular shape upper rung. The hook attachments can also be designed so that the platform device can be used with a step ladder. In order to accomplish this, the top planar wall 28 would extend outwardly from the frame to provide for angle c to be 90 degrees.

While the invention has been particularly shown and described with reference to an embodiment thereof, it will be understood by those skilled in the art that various changes in form and detail may be made without departing from the spirit and scope of the invention.

I claim:

1. A portable attachment for use with a ladder comprising:

a frame having an upper area, a middle area, and a lower area;

said upper area includes a hook-like attachment means that is adapted for engaging a front surface and an upper surface of an upper rung and extends outwardly from a back surface of said ladder and said lower area include a stop that is adapted for engaging a front surface of a lower rung of said ladder to provide for a middle rung to be located between said upper rung and said lower rung when said attachment is in use;

a platform is securely attached to said lower area of said frame for receiving feet of a user, said platform extends rearwardly from said lower rung;

said middle area attaches said upper area to said lower area and said middle area of said frame is permanently at a right angle with respect to said platform; and said hook-like attachment includes an upward wall that is attached to said middle area of said frame at a first obtuse angle and a downward wall that is attached to said upward wall at a right angle, and said stop is at a second obtuse angle with respect to said platform, and said first obtuse angle is equal to said second obtuse angle.

2. An attachment as in claim 1 wherein said middle area of said frame can be adjusted by a length adjusting means.

3. An attachment as in claim 2 wherein said length adjusting means provides for said middle area of said frame to include a first hollow shaft and a second hollow shaft;

said second shaft receives said first shaft to enable said first shaft to slide freely within said second shaft;

said first shaft and said second shaft each includes a plurality of evenly spaced through holes that extend through said first shaft and said second shaft;

said plurality of holes receive a pin when said plurality of holes on said first shaft and said plurality of holes on said second shaft are aligned and a desired length is obtained.

4. An attachment as in claim 2 wherein said plurality of through holes in said first shaft are threaded, said plurality of through holes in said second shaft are threaded, and said pin is threaded.

5. An attachment as in claim 2 wherein said length adjusting means provides for said middle area of said frame to include a first hollow shaft and a second hollow shaft;

said second shaft receives said first shaft to enable said first shaft to slide freely within said second shaft;

said first shaft includes a spring loaded button and said second shaft includes a first set of evenly spaced holes that are located on a front surface; and said first set of evenly spaced holes receive said spring loaded button to provide for a desired length and to provide for said first shaft to be securely affixed to said second shaft.

6. An attachment as in claim 1 wherein said platform includes an upper surface and a lower surface and said upper surface includes a non-skid layer that receives said feet of said user and said lower surface communicates with said lower area of said frame.

7. An attachment as in claim 1 wherein said stop can be moved by a location alteration means.

8. An attachment as in claim 7 wherein said location alteration means includes for said stop be slidable attached to said lower area of said frame.

9. An attachment as in claim 8 wherein said location alteration means further includes a channel to be located on said lower area of said frame;

spacers are located between said platform and said lower area of said frame to provide for a gap to exists between said frame and said platform;

a first plate is located within said gap and is attached via an extension to a second plate;

said extension extends through said channel and said stop is attached to said second plate; and a securing means is located on said first plate and said second plate to permit for said first plate and said second plate to be affixed in a locked and secured position when a desired location for said stop is obtained.

10. An attachment means as in claim 9 wherein said securing means further includes a first set of threaded through holes located on said first plate and a second set of threaded through holes aligned with said first set of threaded through holes and said channel is located on said second plate, and said first set of through holes and said second set of though holes received threaded screw-like devices for securing said plates in a fixed position.

11. An attachment as in claim 3 wherein said stop can be moved by a location alteration means.

12. An attachment as in claim 11 wherein said location alteration means includes for said stop be slidable attached to said lower area of said frame.

13. An attachment as in claim 12 wherein said location alteration means further includes a channel to be located on said lower area of said frame;

spacers are located on between said platform and said lower area of said frame to provide for a gap to exists between said frame and said platform;

a first plate is located within said gap and is attached via an extension to a second plate;

said extension extends through said channel and said stop is attached to said second plate; and a securing means is located on said first plate and said second plate to permit for said first plate and said second plate to be affixed in a locked and secured position when a desired location for said stop is obtained.

14. An attachment means as in claim 13 wherein said securing means further includes a first set of threaded through holes located on said first plate and a second set of threaded through holes aligned with said first set of threaded through holes and said channel is located on said second plate, and said first set of through holes and said second set of though holes received threaded screw-like devices for securing said plates in a fixed position.

* * * * *